US009359171B1

(12) United States Patent
Nowel

(10) Patent No.: US 9,359,171 B1
(45) Date of Patent: Jun. 7, 2016

(54) SAFETY SYSTEM FOR A LIFT INSTALLATION AND SAFETY HELMET AS INDIVIDUAL COMPONENT OF SUCH A SAFETY SYSTEM

(71) Applicant: Inventio AG, Hergiswil (CH)

(72) Inventor: Edward Nowel, Columbia, NJ (US)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 14/600,237

(22) Filed: Jan. 20, 2015

(51) Int. Cl.

| | |
|---|---|
| ***B66B 1/34*** | (2006.01) |
| ***B66B 5/00*** | (2006.01) |
| ***B66B 3/02*** | (2006.01) |
| ***A42B 3/04*** | (2006.01) |

(52) U.S. Cl.
CPC ..... *B66B 5/0062* (2013.01); *A42B 3/0453* (2013.01); *B66B 3/02* (2013.01); *B66B 5/0068* (2013.01)

(58) Field of Classification Search
CPC .... B66B 5/0025; B66B 5/0043; B66B 5/005; B66B 5/0056; B66B 5/0062; B66B 3/02; B66B 5/0068; A42B 3/0453
USPC ..... 187/391–394, 399, 277, 288, 298, 300, 187/306; 340/505, 506, 518, 522, 541, 565
See application file for complete search history.

(56) References Cited

U.S. PATENT DOCUMENTS

| | | | | |
|---|---|---|---|---|
| 5,773,771 | A * | 6/1998 | Chatham | 187/282 |
| 6,202,797 | B1 * | 3/2001 | Skolnick et al. | 187/317 |
| 6,481,537 | B1 * | 11/2002 | Malone et al. | 187/391 |
| 6,736,242 | B2 * | 5/2004 | Nygren | 187/357 |
| 7,249,656 | B2 * | 7/2007 | Huber et al. | 187/343 |
| 7,258,202 | B1 * | 8/2007 | Rossignol | 187/351 |
| 7,281,609 | B2 * | 10/2007 | Del Rio Sanz et al. | 187/316 |
| 7,954,606 | B2 * | 6/2011 | Tinone et al. | 187/384 |
| 8,061,486 | B2 * | 11/2011 | Monzon et al. | 187/392 |
| 8,556,043 | B2 * | 10/2013 | Mangini et al. | 187/392 |
| 2005/0275513 | A1 * | 12/2005 | Grisham et al. | B60Q 9/008 340/435 |
| 2010/0018809 | A1 * | 1/2010 | Peacock et al. | 187/251 |
| 2012/0305334 | A1 * | 12/2012 | Kocher et al. | 187/247 |

FOREIGN PATENT DOCUMENTS

| | | | |
|---|---|---|---|
| JP | 2005132543 | A * | 5/2005 |
| WO | 2007018540 | A1 | 2/2007 |
| WO | WO 2007018540 | A1 * | 2/2007 |

* cited by examiner

*Primary Examiner* — Anthony Salata
(74) *Attorney, Agent, or Firm* — Fraser Clemens Martin & Miller LLC; William J. Clemens

(57) ABSTRACT

A safety system for a lift installation includes a safety helmet having an integrated person position indicator being a transmitter and/or receiver and an installation position indicator mounted in lift installation, especially in the lift shaft. The indicators cooperate to automatically determine potential risk situations for an engineer wearing the safety helmet such an approaching lift cage or an approaching counterweight. The safety system automatically triggers an appropriate safety function, for example, stopping of the lift cage.

11 Claims, 5 Drawing Sheets

SAFETY SYSTEM FOR A LIFT INSTALLATION AND SAFETY HELMET AS INDIVIDUAL COMPONENT OF SUCH A SAFETY SYSTEM

FIELD

The invention relates primarily to a safety system for a lift installation. The lift installation comprises, in mode and manner known per se, at least one lift cage, which is movable in a lift shaft, with a counterweight conjunctively moved in opposite sense during travel of the lift cage. The invention additionally also relates to a safety helmet as an individual component of such a safety system.

BACKGROUND

Lift installations of that kind are known per se. Equally known per se is that in the case of installation or maintenance of a lift installation there is the threat of significant risks and accordingly precautions have to be taken in special mode and manner for the personnel tasked therewith, especially an engineer, who stands in the lift shaft. With regard to the prior art in this respect reference can be made to JP 2005-132543 A, U.S. Pat. No. 6,202,797 B and WO 2007/018540 A. Particularly risky areas in that case are the foot of the lift shaft (shaft pit) and the upper end of the lift shaft (shaft head).

A safety system is proposed in JP 2005-132543 A, U.S. Pat. No. 6,202,797 B and WO 2007/018540 A in which the engineer carries a wireless transmitter/receiver and at least one transmitter for wireless transmission of a signal is mounted on each of the lift cage and the counterweight. In the case of JP 2005-132543 A the receiver carried by the engineer receives a signal from a transmitter of the lift cage or the counterweight when the engineer approaches this and the engineer receives a warning report. By means of the transmitter carried by the engineer, a signal is transmitted in parallel to a receiver unit of the lift installation which is to cause the lift control to stop the movement of the lift cage. In the case of U.S. Pat. No. 6,202,797 B the engineer similarly carries a transmitter/receiver and, in particular, as part of his or her uniform. In the case of WO 2007/018540 A the engineer carries a safety device in the form of a headset. Disposed in the lift shaft and functioning, so to speak, as a movement reporting device is an ultrasonic transmitter/receiver which is to recognize the presence of an engineer in particularly risky areas, namely the foot and the upper end of the lift shaft. If the lift cage or the counterweight is in the vicinity of the engineer the safety device receives a warning signal by means of an ultrasonic receiver and as a consequence of the warning signal an acoustic warning report to the engineer is carried out by means of a loudspeaker included in the safety equipment. The circumstance of whether the lift cage or the counterweight is in the vicinity of the engineer is to be recognized by means of transmitter/receiver pairs arranged in the lift shaft and at the lift cage.

The previous safety systems seem capable of further improvement. The detection of an engineer by means of a movement sensor is susceptible to error and does not, for example, recognize an engineer when the engineer is carrying out a measurement and in that case does not move or hardly moves for some time. The approach presented in U.S. Pat. No. 6,202,797 B requires the engineer to wear his uniform at all times. In the case of JP 2005-132543 A the engineer similarly has to carry the transmitter/receiver.

SUMMARY

Starting from this prior art an object of the present invention is to indicate a safety system for a lift installation which excludes to still further extent system errors and human errors. The lift installation is a lift installation of a kind basically known per se, thus a lift installation with at least one lift cage movable in a lift shaft. The safety system comprises at least one transmitter and/or receiver associated with the lift installation as well as at least one transmitter and/or receiver which is able to be carried or is carried by an engineer. The transmitter and/or receiver associated with the lift installation allows or allow detection of a position of a component of the lift installation and is termed installation position indicator in the following. The transmitter and/or receiver carried or able to be carried by the engineer allows or allow detection of a position of the engineer and is or are correspondingly termed—and for distinction from the installation position indicator—person position indicator in the following. Each position indicator (installation position indicator, person position indicator) is intended and equipped for wireless communication with other position indicators and/or other units of the safety system. In that case, it is basically of no consequence whether a position indicator functions as a transmitter and, for example, actively emits a radio signal or functions as a receiver and can receive, for example, merely a radio signal emitted by a transmitter or functions both as a transmitter and as a receiver. In every case one of the position sensors functions as a proximity sensor for the other position sensor. A safety function, thus, for example, stopping of the lift cage, can be triggered in the safety system when a person position indicator comes into a receiving region of an installation position indicator or conversely. The special feature of the safety system is that the person position indicator is integrated in a safety helmet or mounted thereon.

The installation position indicator can in that case be disposed on at least one part movable within the scope of operation of the lift installation, thus, for example, on the lift cage and/or a counterweight. If, in the case of such a configuration, the person position indicator comes into a receiving region of an installation position indicator or conversely it is evident therefrom that, for example, the lift cage or the counterweight approaches the engineer and accordingly a potential risk situation results. In that case it does not matter in terms of function whether the person position indicator functions as transmitter and emits a radio signal, which on entry into the detection range of the installation position indicator can be received by this so that the safety function—for example stopping of the lift cage—can be triggered on the basis of such reception, or whether the installation position indicator as transmitter emits a radio signal, which on entry into the detection range of the person position indicator can be received by this so that the safety function—for example, an optical and/or acoustic signal for the engineer—can be triggered on the basis of such reception.

Alternatively or additionally, also corning into consideration is the fact that the installation position indicator associated with the lift installation is arranged in stationary position in the lift shaft, for example in the region of a foot, which in technical terminology is usually termed shaft pit, of the lift shaft, and/or in the region of an upper end of the lift shaft. The installation position indicator thus defines, as it were, a safety zone. If the engineer together with his or her person position indicator is present in the detection range of an installation position indicator it is automatically recognizable on this basis whether the engineer is present in the respective safety zone and the safety zone is, so to speak, automatically activated by means of the person position indicator. In that case, it is again of no consequence—as described further above—which of the two position indicators functions as transmitter or receiver. If the lift cage or the counterweight approaches the activated safety zone, a safety function, for example stopping of the lift cage or restriction of its permissible travel range or triggering of an optical and/or acoustic signal for the engineer, can be triggered. The approach of the lift cage or the counterweight to the safety zone or entry into the activated safety zone can in that case be determined in different ways. On the one hand, coming into consideration is the use of position information detected in usual mode and manner, such as is also used in order to correctly position the lift cage at a passenger or normal stop. On the other hand or additionally, also coming into consideration is use of a further transmitter/receiver combination, in which case a transmitter or receiver is arranged on the lift cage and/or counterweight and each installation position indicator functions as co-operating receiver/transmitter.

The advantage of the invention consists in the fact that with the person position indicator in or on the safety helmet of the engineer it is ensured with increased certainty that the engineer does not walk into the lift shaft without the person position indicator making possible the safety function, since the safety helmet belongs to the natural equipment of an engineer and every engineer is accustomed to wearing a safety helmet during his or her work, especially when working in a lift shaft.

In one form of embodiment of the safety system the safety function includes an immediate stop of the movement of the lift cage (16). In other words, stopping of the lift cage can be triggered by the safety system when a person position indicator integrated in the engineer's helmet comes into a receiving region of an installation position indicator or conversely.

In a further form of embodiment of the safety system the safety function includes one or both of an acoustic warning signal and an optical warning signal. This means that the engineer is alerted by an acoustic warning signal or an optical warning signal or both of them in case the person position indicator integrated in his helmet comes into a receiving region of an installation position indicator or conversely.

In a further form of embodiment of the safety system the safety function includes a temporary restriction of the zones in which the lift cage (16) or a counterweight (18) are permitted to travel. This means that when the person position indicator integrated in the engineer's helmet comes into a receiving region of an installation position indicator or conversely, a control system of the lift installation registers the position of the lift cage and restricts further traveling of the lift cage so that the lift cage does neither reach nor pass said position. This restriction can be reset automatically after a predetermined period of time or manually by the engineer.

In a further form of embodiment of the safety system a passive RFID transponder functions as person position indicator. Such a transponder has the advantage of being independent of an energy source such as, for example, a battery or the like. The engineer can accordingly depend on the person position indicator being able to fulfil its function at any time, namely to indicate, in an automatically evaluatable mode and manner, the presence of the engineer in a specific region of the lift shaft.

In a further form of embodiment of the safety system the person position indicator, particularly an RFID transponder functioning as a person position indicator, is embedded in a helmet shell or a so-called interior fitment of a safety helmet. Through the embedding in, for example, the helmet shell, which is usually made of a plastics material, the person position indicator is protected from mechanical damage as well as environmental influences such as dust or moisture. Embedding in, for example, the plastics material of the helmet shell is also readily possible in the case of an RFID transponder functioning as a person position indicator, because such transponders can, as is known, be of very small construction. In addition, by virtue of the embedding, thus the permanent connection with the safety helmet, the person position indicator cannot be demounted or unintentionally forgotten.

In a further form of embodiment of the safety system the person position indicator, particularly an RFID transponder functioning as person position indicator, is mounted in a region between an interior fitment of the safety helmet and a helmet shell of the safety helmet. The intermediate space between the interior fitment, which bears against the head of the wearer, and the inner side of the safety helmet is particularly well suited to the mounting of the person position indicator without in that case impairing the protective function of the safety helmet.

In one form of embodiment of the safety system in which the person position indicator is mounted in an intermediate space between the interior fitment and the inner side of the safety helmet it is provided that the person position indicator is glued to the helmet shell on the inner side thereof or is connected therewith in another suitable mode and manner. Through the gluing or a corresponding form of connection it is ensured that the person position indicator is at least not unintentionally forgotten. The gluing or the like in addition protects the person position indicator and comes into consideration particularly for the conductor, which functions as an antenna, of an RFID transponder.

In general, the invention is also a safety helmet with an integrated person position indicator or a person position indicator connected therewith, wherein the safety helmet is intended and equipped by means of the person position indicator for the purpose of functioning as an individual component in a safety system of the kind described here and in the following. Moreover, the invention is also the use of such a safety helmet as an individual component in a safety system of the kind described here and in the following.

DESCRIPTION OF THE DRAWINGS

An embodiment of the invention is explained in more detail in the following by way of the drawing. Subjects or elements corresponding with one another are provided with the same reference numerals in all figures, in which.

DETAILED DESCRIPTION

Figure 1:
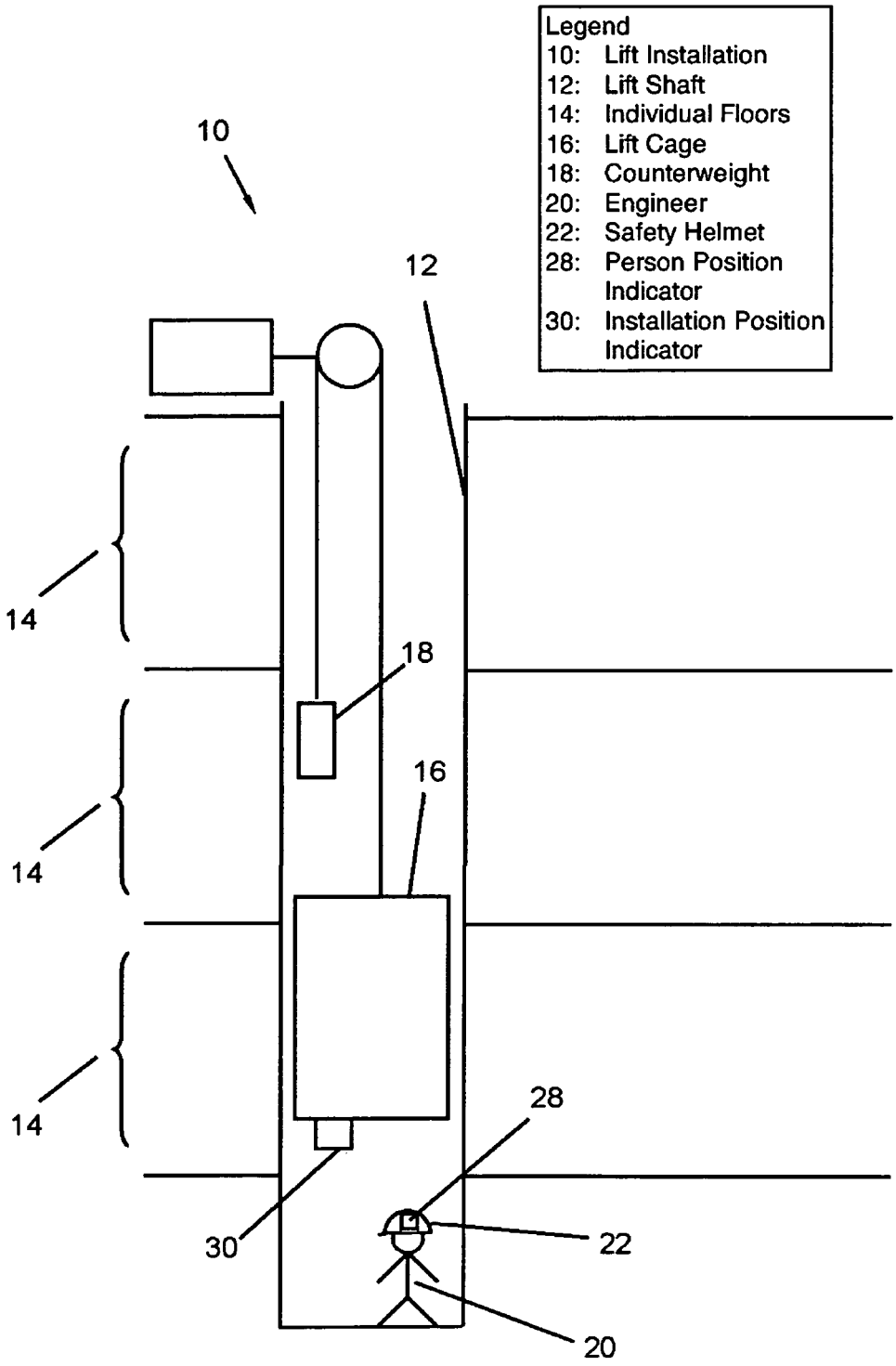
FIG. 1 and FIG. 2 show a schematic elevation view of a lift installation according to the invention.
Figure 2:
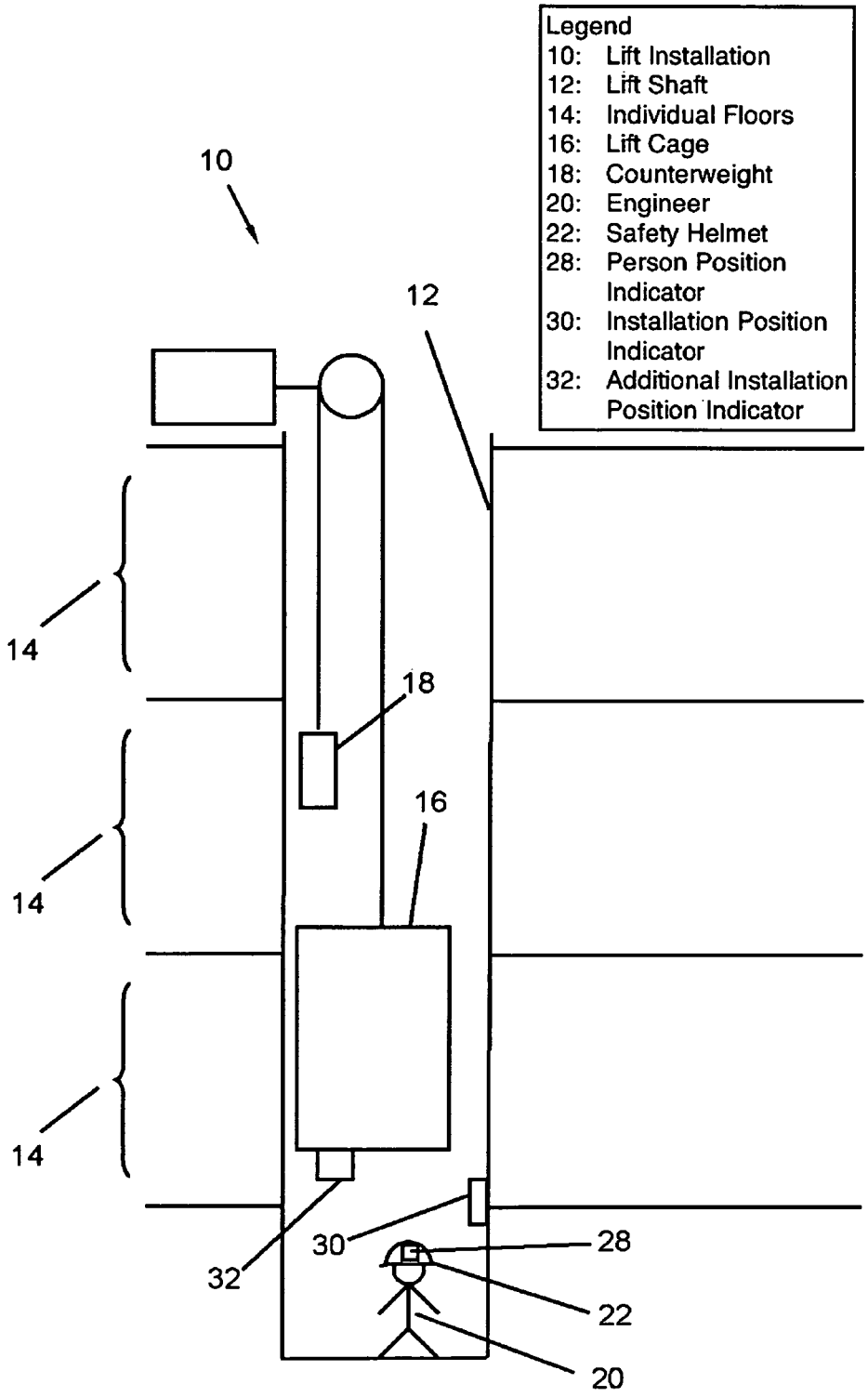

The illustrations in FIG. 1 and FIG. 2 show, in schematic simplified form, a lift installation 10 with a lift cage 16, which is movable in a lift shaft 12 in a mode and manner known per se between individual floors 14 or other stopping positions of the building, as well as a counterweight 18 moved conjunctively and in opposite sense when movement of the lift cage 16 takes place. Although the lift installation 10 is shown in the drawing with only one lift cage 16, the invention is equally applicable to more complex lift installations with several lift shafts 12 or several lift cages 16 in the same lift shaft 12.

An engineer 20 standing on the base of the lift shaft 12 (shaft pit) is located in an area of risk and, for avoidance of risks to life and limb of the engineer 20, the lift cage 16 (or the counterweight 18) must stop safely above the engineer 20. A comparable risk situation is present if the engineer 20 is on the roof of the lift cage 16 and this approaches the upper end of the lift shaft 12. Then, as well, the lift cage 16 has to stop in good time before the end of the lift shaft 12.

Figure 3:
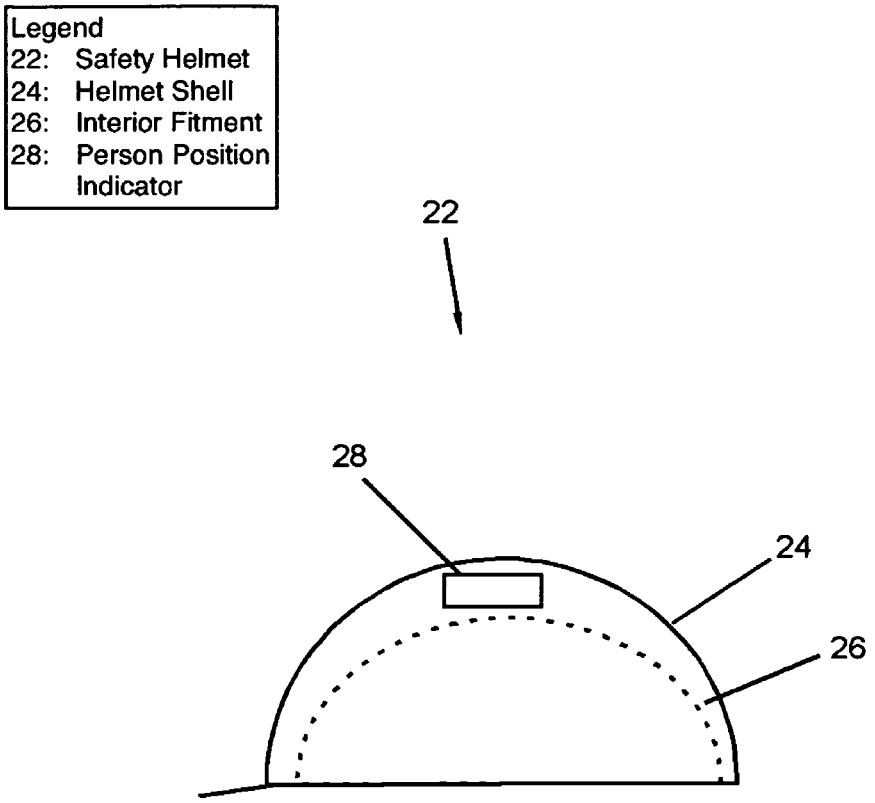
FIG. 3 shows a schematic view of a safety helmet according to the invention.
Figure 4:
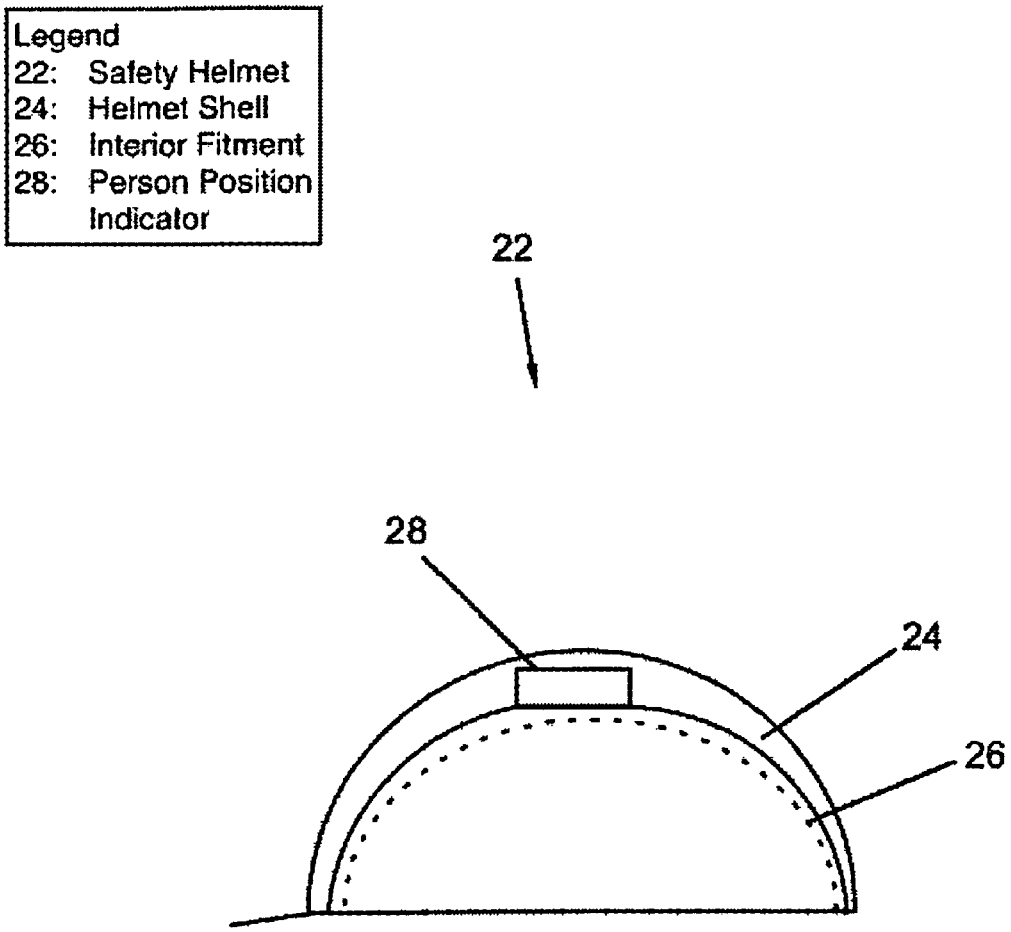
FIG. 4 shows a schematic view of another safety helmet according to the invention.

The engineer 20 wears—as is usual when working in an area of risk, namely here the lift shaft 12—a safety helmet 22. The safety helmet 22 is shown in the illustration in FIG. 3 in schematically simplified form with further details. According to that, the safety helmet 22 comprises, in usual mode and manner, a helmet shell 24 as well as a so-called interior fitment 26 in the inside of the helmet shell 24, thus a belt arrangement or the like, which is placeable on the head of the respective wearer and ensures spacing of the inner side of the helmet shell 24 from the head of the wearer. In the case of the approach presented here the safety helmet 22 functions as an individual component in a safety system described in the following. For that purpose the safety helmet 22 comprises a device which functions as a wireless transmitter and/or receiver and by means of which an indirect or a direct detection of a position of the engineer 20 in the lift shaft 12 is possible. The device is hereinafter termed person position indicator 28 in correspondence with its function. In the illustration in FIG. 3 the person position indicator 28 is shown in an intermediate space between an inner side of the helmet shell 24 and the interior fitment 26. Equally, the person position indicator 28 can be integrated in the helmet shell 24, embedded in the helmet shell 24 as shown in FIG. 4, or mounted on the inner side of the helmet shell 24, for example by gluing.

The person position indicator 28 co-operates with a corresponding device which is associated with the lift installation 10 and which functions as a wireless transmitter and/or receiver. For distinction from the person position indicator 28 this is termed installation position indicator 30. In the illustration in FIG. 1, an installation position indicator 30 mounted on the lift cage 16 is shown. A further installation position indicator 30 (not shown) is usually located on the counterweight 18. Detection of a position of the lift cage 16 and/or of the counterweight 18 in the lift shaft 12, thus detection of relevant position information with respect to lift installation 10, is indirectly or directly possible by means of each installation position indicator 30. The designation of the relevant device as installation position indicator 30 results therefrom.

If a person position indicator 28 functioning as a transmitter is in or comes into a receiving range of an installation position indicator 30 functioning as receiver or an installation position indicator 30 functioning as transmitter is in or comes into a receiving range of a person position indicator 28 this means a potential risk situation due to a lift cage 16 approaching the engineer 20 (or due to a counterweight 18 approaching the engineer 20). Correspondingly, in this case a safety function, thus for example stopping of the lift cage 16 and/or generation a warning signal for the engineer 20, is automatically triggered.

The illustration in FIG. 2 shows, by comparison with the illustration in FIG. 1, a different configuration of the safety system. The installation position indicator 30 is in that case located not on the lift cage 16 and/or the counterweight 18, but instead is mounted in stationary position in the lift shaft 12. In this configuration of the safety system as well, a safety function, thus, for example, stopping of the lift cage 16, can be triggered when a person position indicator 28 is in or comes into the receiving range of an installation position indicator 30 or an installation position indicator 30 is in or comes into the receiving range of a person position indicator 28. The installation position indicator 30 in that case defines, so to speak, a safety zone for the region in which the engineer 20 stands, in which case the safety zone is activated by means of the person position indicator 28. By the activation of the installation position indicator 30 and the accompanying activation of the safety zone defined by the installation position indicator 30 the triggering of a respective safety function is possible. An actual triggering of a safety function takes place when the lift cage 16 (or the counterweight 18) approaches or enters the safety zone defined by the installation position indicator 30 and activated by the person position indicator 28.

Figure 5:
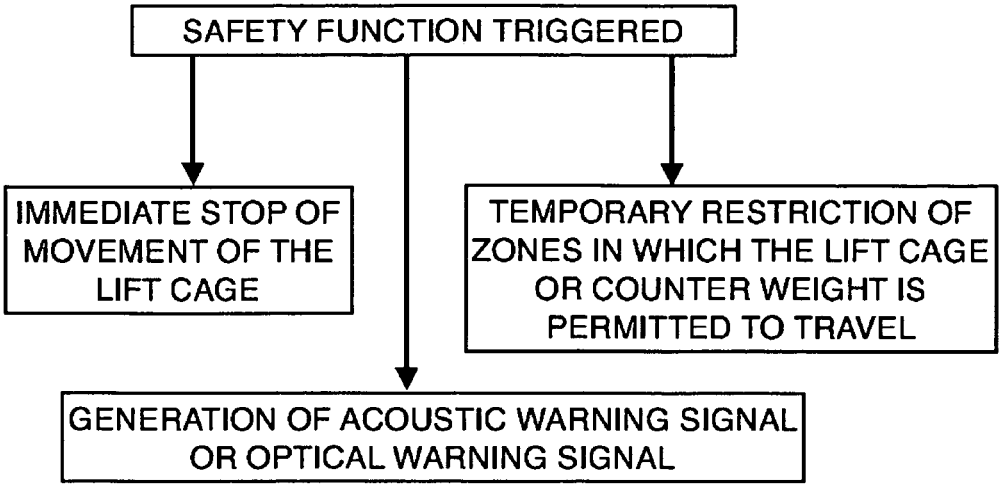
FIG. 5 shows a flow diagram of various actions following the triggering of a safety function.

FIG. 5 shows a flow diagram of various actions following the triggering of a safety function. The actions include an immediate stop of movement of the lift cage, generation of acoustic warning signal or optical warning signal, and temporary restriction of zones in which the lift cage or counter weight is permitted to travel.

This can be automatically recognized by means of a further transmitting and/or receiving device 32 mounted on the lift cage 16 (and/or on the counterweight 18). This co-operates with the installation position indicator 30 and if this enters a receiving range of the installation position indicator 30 or if the installation position indicator 30 enters the receiving range thereof, the approach to or the entry into the safety zone is automatically recognizable. Alternatively or additionally the approach to or entry into the safety zone can also take place automatically with use of position information normally known in any case for the respective position of the lift cage 16. In that case, the position information is automatically compared with further position information by, for example, the respective lift control. This further position information arises on the basis of a respectively known mounting location of the installation position indicator 30 or a respective installation position indicator 32. Regardless of how in the individual case the approach to or the entry into the safety zone defined by an installation position indicator 30 is recognized a plurality of installation position indicators 30 can be located in the lift shaft 12 in order to there define different safety zones, for example at least one safety zone in the region of the foot of the lift shaft 12 as well as a safety zone in the region of an upper end of the lift shaft 12.

Although the invention has been more closely illustrated and described in detail by the embodiment the invention is not restricted by the disclosed example or examples and other variations can be derived therefrom by the expert without departing from the scope of protection of the invention.

Individual aspects, which are in the forefront, of the description filed here can thus be briefly summarized as follows: a safety system for a lift installation 10 is indicated, as well as a safety helmet 22 usable as an individual component in such a safety system, wherein integrated in the safety helmet 22 is a device which functions as a transmitter and/or receiver and by means of which information with respect to a position of a wearer of the safety helmet 22 in the region of the lift installation 10, specifically in the lift shaft 12, can be automatically ascertained (person position indicator 28) so that by means of such position information it is possible to automatically recognize potential risk situations, thus an approaching lift cage 16 or an approaching counterweight 18, and to equally automatically trigger an appropriate safety function, for example stopping of the lift cage 16.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety system for a lift installation with at least one lift cage movable in a lift shaft, comprising:

a first transmitter and/or receiver mounted in stationary position at an upper end of the lift shaft or at lower end of the lift shaft and operating as a first installation position indicator;

a second transmitter and/or receiver mounted on the lift cage and/or counter weight and operating as a second installation position indicator;

a passive radio-frequency identification (RFID) transponder carried by an engineer and operating as a person position indicator, wherein the system is configured to define a safety zone when the passive RFID transponder is in a receiving range of the first installation indicator, a safety function of the lift installation is triggered when the second installation position indicator approaches or enters the safety zone; and the person position indicator being integrated in or mounted on a safety helmet adapted to be worn by the engineer working on the lift installation.

2. The safety system according to claim 1 wherein the safety function includes an immediate stop of the movement of the lift cage.

3. The safety system according to claim 1 wherein the safety function includes generation of an acoustic warning signal or an optical warning signal.

4. The safety system according to claim 1 wherein the safety function includes a temporary restriction of zones in which the lift cage or a counterweight is permitted to travel.

5. The safety system according to claim 1 wherein the at least one installation position indicator is mounted for movement within the lift shaft.

6. The safety system according to claim 1 wherein the at least one installation position indicator is mounted in a stationary position in the lift shaft.

7. The safety system according to claim 1 wherein the at least one person position indicator is embedded in a helmet shell of the safety helmet.

8. The safety system according to claim 1 wherein the at least one person position indicator is mounted in a region between an interior fitment of the safety helmet and a helmet shell of the safety helmet.

9. The safety system according to claim 1 wherein the at least one person position indicator is glued to an inner side of a helmet shell of the safety helmet.

10. A safety helmet for use in a lift installation comprising a person position indicator integrated into the safety helmet, wherein the safety helmet with the person position indicator operates as an individual component in a safety system of the lift installation.

11. A method of operating a safety system of a lift installation comprising the steps of:

providing a safety helmet with a passive radio-frequency identification (RFID) transponder operating as a person position indicator integrated in or mounted on the safety helmet;

providing a first transmitter and/or receiver mounted in stationary position at an upper end of the lift shaft or at lower end of the lift shaft and operating as a first installation position indicator;

providing a second transmitter and/or receiver mounted on the lift cage and/or counter weight and operating as a second installation position indicator;

an engineer wearing the safety helmet while present in the lift installation;

defining a safety zone when the passive RFID transponder is in a receiving range of the first installation indicator, and triggering a safety function of the lift installation when the second installation position indicator approaches or enters the safety zone.

* * * * *